US009748672B2

(12) United States Patent
Pizzi

(10) Patent No.: US 9,748,672 B2
(45) Date of Patent: Aug. 29, 2017

(54) INSULATED JUMPER OF THE SCREW TYPE IN PARTICULAR FOR TERMINAL BLOCKS OF SWITCHBOARDS

(71) Applicant: Morsettitalia S.p.A., Milan (IT)

(72) Inventor: Giordano Pizzi, Milan (IT)

(73) Assignee: Morsettitalia S.p.A., Milan (IT)

( * ) Notice: Subject to any disclaimer, the term of this patent is extended or adjusted under 35 U.S.C. 154(b) by 0 days.

(21) Appl. No.: 15/007,441

(22) Filed: Jan. 27, 2016

(65) Prior Publication Data

US 2016/0218448 A1 Jul. 28, 2016

(30) Foreign Application Priority Data

Jan. 27, 2015 (IT) ..... M2015A0093

(51) Int. Cl.

| | |
|---|---|
| ***H01R 31/08*** | (2006.01) |
| ***H01R 4/34*** | (2006.01) |
| ***H01R 9/24*** | (2006.01) |
| *H01R 4/30* | (2006.01) |

(52) U.S. Cl.

CPC ..... *H01R 4/34* (2013.01); *H01R 9/2408* (2013.01); *H01R 9/2466* (2013.01); *H01R 4/301* (2013.01)

(58) Field of Classification Search

CPC .. H01R 13/7032; H01R 31/08; H01R 31/085; H01R 31/00; H01R 31/02; H01R 13/11; H01R 11/09; H01R 4/4818; H05K 3/222; H01L 23/60

USPC ..... 439/801, 507, 885, 814

See application file for complete search history.

(56) References Cited

U.S. PATENT DOCUMENTS

| | | | | |
|---|---|---|---|---|
| 1,579,400 A * | 4/1926 | Samuels | ..... | H01R 9/2475 361/823 |
| 1,952,554 A | 3/1934 | Lavarack | | |
| 1,961,111 A * | 5/1934 | Rovere | ..... | H01R 9/226 379/325 |

(Continued)

FOREIGN PATENT DOCUMENTS

| | | |
|---|---|---|
| EP | 0893859 A2 | 1/1999 |
| EP | 1876674 A1 | 1/2008 |
| WO | 2004105188 A1 | 12/2004 |

*Primary Examiner* — Abdullah Riyami
*Assistant Examiner* — Vladimir Imas
(74) *Attorney, Agent, or Firm* — Mintz Levin Cohn Ferris Glovsky and Popeo, P.C.

(57) ABSTRACT

An electrical connection jumper is of the screw type for terminal blocks of switchboards. The jumper includes conducting body including at least two sub-bodies, each with a shape substantially in the form of an overturned "U", insulating body including at least two sub-bodies with a substantially parallelepiped shape made of suitable insulating material, connected together longitudinally by a vertical membrane with a reduced thickness in the transverse direction. Insulating body has a plane for coupling with the conducting body. The coupling plane includes, between each sub-body and adjacent sub-body, a pair of arched lugs arranged opposite each other in the transverse direction and extending in the longitudinal direction so that the respective vertical arms are respectively connected to each one of the adjacent sub-bodies. Each arched lug has a tooth extending in the transverse direction towards the inside of the insulating body in empty space between the two sub-bodies.

10 Claims, 3 Drawing Sheets

(56) References Cited

U.S. PATENT DOCUMENTS 2,411,014 A * 11/1946 Warnke ..... H01R 9/24 439/491
2,900,618 A * 8/1959 Geier ..... H01R 4/36 439/812
3,665,376 A * 5/1972 Paris ..... H01R 9/24 439/721
3,728,656 A * 4/1973 Neuber ..... H01R 9/2458 323/346
3,775,733 A * 11/1973 Ege ..... H01R 9/2491 439/712
4,070,086 A * 1/1978 Trafford ..... H01R 12/515 439/717
4,130,331 A * 12/1978 Neff ..... H01R 4/2462 439/396
4,171,861 A * 10/1979 Hohorst ..... H01R 4/4845 439/49
4,889,504 A * 12/1989 Barbier ..... H01R 4/34 439/712
5,149,278 A * 9/1992 Waas ..... H01R 4/2408 439/412
5,322,458 A * 6/1994 Hennemann ..... H01R 4/4845 439/723
5,669,788 A * 9/1997 Brockman ..... H01R 9/2675 439/511
5,905,230 A * 5/1999 Marik ..... H02G 3/0691 174/651
5,915,998 A * 6/1999 Stidham ..... H01R 4/36 439/521
6,157,287 A * 12/2000 Douglass ..... H01H 85/203 337/159
6,222,717 B1 * 4/2001 Waas ..... H01R 4/2433 361/119
7,168,977 B2 * 1/2007 Reibke ..... H01R 31/08 439/507
7,413,486 B2 * 8/2008 Pizzi ..... H02B 1/205 439/787
7,458,840 B2 * 12/2008 Pratt ..... H01R 4/2433 439/409
7,748,117 B2 * 7/2010 Pizzi ..... H01H 69/02 264/272.15
7,862,389 B2 * 1/2011 Pizzi ..... H01R 4/28 439/709
7,892,032 B2 * 2/2011 Pizzi ..... H01R 13/68 439/620.33
8,011,962 B2 * 9/2011 Pizzi ..... H01R 4/363 439/607.41
8,651,902 B2 * 2/2014 Wu ..... H01R 4/363 439/709
9,153,916 B2 * 10/2015 Schloo ..... H01R 9/2491
2002/0067279 A1 * 6/2002 Torrez ..... H01H 85/306 340/638
2006/0128232 A1 * 6/2006 Kim ..... H01R 4/301 439/813
2007/0293082 A1 * 12/2007 Sumitani ..... H01H 85/2035 439/507
2008/0248698 A1 * 10/2008 Pizzi ..... H01R 13/68 439/709
2009/0017702 A1 * 1/2009 Pizzi ..... H01R 4/363 439/812
2017/0025805 A1 * 1/2017 Pizzi ..... H01R 9/2675

* cited by examiner

INSULATED JUMPER OF THE SCREW TYPE IN PARTICULAR FOR TERMINAL BLOCKS OF SWITCHBOARDS

RELATED APPLICATIONS

This application claims priority under 35 U.S.C. §119 to Italian Application No. MI2015A000093 filed Jan. 27, 2015, the entire contents of which are hereby incorporated by reference herein.

TECHNICAL FIELD

The present subject matter relates to an insulated jumper of the screw type in particular for terminal blocks of switchboards and the like.

BACKGROUND

It is known, in the technical sector relating to terminal blocks for switchboards, that there exists the need to connect together two terminals situated alongside each other on the switchboard, in order to perform the required electrical connection. Also known are jumpers which are made of conductive material and which are designed for this purpose; among the known jumpers the following in particular may be distinguished:

- jumpers which are configured with two elastic jaws designed to form the element for engagement in a seat of the terminal block with corresponding electrical contact in the transverse direction provided by the elastic force, which pushes the contact plates against the walls of a hole in a conducting bar for connecting together the opposite terminals of the terminal block (EP 1 876 674 discloses multiple connection jumpers of the jaws type having an over-moulded insulating body); and
- screw-type jumpers by means of which electrical contact occurs in the vertical direction as a result of the foot of the jumper making contact on a conducting bar connecting together the opposite terminals of the terminal block, the contact being achieved by tightening a screw inside the female thread of a hole formed in said bar.

These screw-type jumpers, although performing their function, nevertheless have a number of drawbacks arising in particular from the difficulty of separating a pair of jumpers from a strip of a plurality of said jumpers, while limiting the number of jumpers which are left singly attached to the strip and are no longer usable.

In addition the known jumpers have the drawback due to the fact that the locking screw is not electrically insulated from the outside and also tends to come loose owing to the vibrations which are generated during the movements of the terminal or owing to positioning in unsuitable environments.

U.S. Pat. No. 1,952,554 includes a plural unit terminal block integrally formed simulating a plurality of single unit blocks integrally connected together by easily frangible means of relatively small cross-section between adjacent blocks and substantially sharp V-like impressions in the frangible means extending transversely thereof for promoting the certainty of start of a frangible means fracture at a definite place.

WO 2004/105 188 A1 discloses an insulating terminal cover, which has through holes and snapping means for coupling to an insulating housing of a single unit terminal.

SUMMARY

The technical problem posed is therefore that of providing electrical connection jumpers of the screw type, in particular for terminal blocks of switchboards, designed to be electrically insulated from the outside and ensure the insulation of the conducting parts so as to prevent them from coming into contact with the user and/or with foreign bodies, causing short-circuiting of the installation.

In connection with this problem, this jumper can preferably be able to be easily cut to size from multiple strips, have small overall dimensions, be easy and inexpensive to produce and assemble and be able to be used at any user location without the aid of cutting means for dividing/separating the jumpers.

These results are obtained according to the present subject matter by an electrical connection jumper of the screw type in particular for terminal blocks of switchboards and the like. For example, the current subject matter relates to an electrical connection jumper of the screw type, in particular for terminal blocks of switchboards, extending in a longitudinal lengthwise direction (X-X), transverse widthwise direction (Y-Y) and vertical direction (Z-Z) perpendicular to the preceding directions. The jumper includes a conducting body, an insulating body, and at least two screws. The conducting body includes at least two conducting sub-bodies, each with a shape substantially in the form of an overturned "U". Each conducting sub-body includes a respective head and respective contact plates. The respective head lays in a plane parallel to the longitudinal direction and transverse direction. The contact plate may lay in planes parallel to the longitudinal direction and vertical direction and arranged opposite each other in the transverse direction relative to the head. Each head has a vertical through-hole. The at least two conducting sub-bodies are connected in the longitudinal direction by means of a tongue. The insulating body includes at least two sub-bodies with a substantially parallelepiped shape made of suitable insulating material, connected together longitudinally by a vertical membrane with a small thickness in the transverse direction. Each insulating sub-body is passed through by a respective vertical through-hole. The insulating body has a plane for coupling with the conducting body, which coupling plane includes, between each sub-body and the adjacent sub-body, a pair of arched lugs situated opposite each other in the transverse direction and extending in the longitudinal direction so that the respective vertical arms are respectively connected to each one of the adjacent sub-bodies. Each arched lug has a tooth extending in the transverse direction towards the inside of the insulating body in the empty space between the two sub-bodies. The arched lugs with tooth allow relative reversible engagement of the insulating body and the conducting body. The at least two screws are for performing fixing to a terminal block. Each screw being suitable for insertion into the through-hole of a respective sub-body of the insulating sub-bodies.

DESCRIPTION OF DRAWINGS

Further details may be obtained from the following description of a non-limiting example of an embodiment of the present subject matter, provided with reference to the accompanying drawings, in which.

DETAILED DESCRIPTION

Figure 1A:
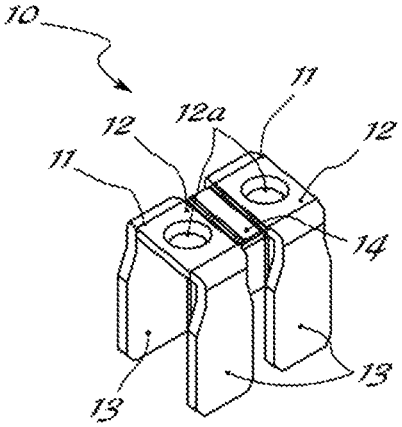
FIGS. 1*a-c* show an exploded view of a screw-type jumper according to the present subject matter.
Figure 1C:
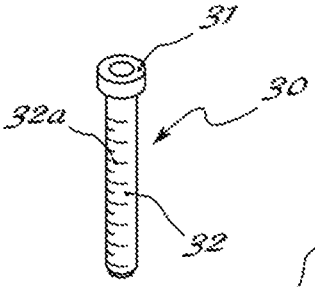
Figure 1B:
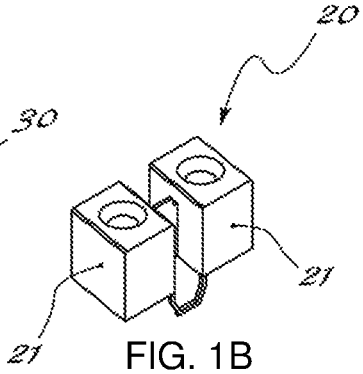

FIG. 1*a-c* shows an exploded view of an example screw-type jumper. The jumper for terminal blocks of switchboards according to the present subject matter includes a conducting body 10, an insulating body 20 and a screw 30.

Figure 2:
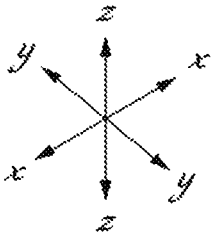
FIG. 2 shows a perspective view of the conducting body of the jumper according to the present subject matter.
Figure 2:
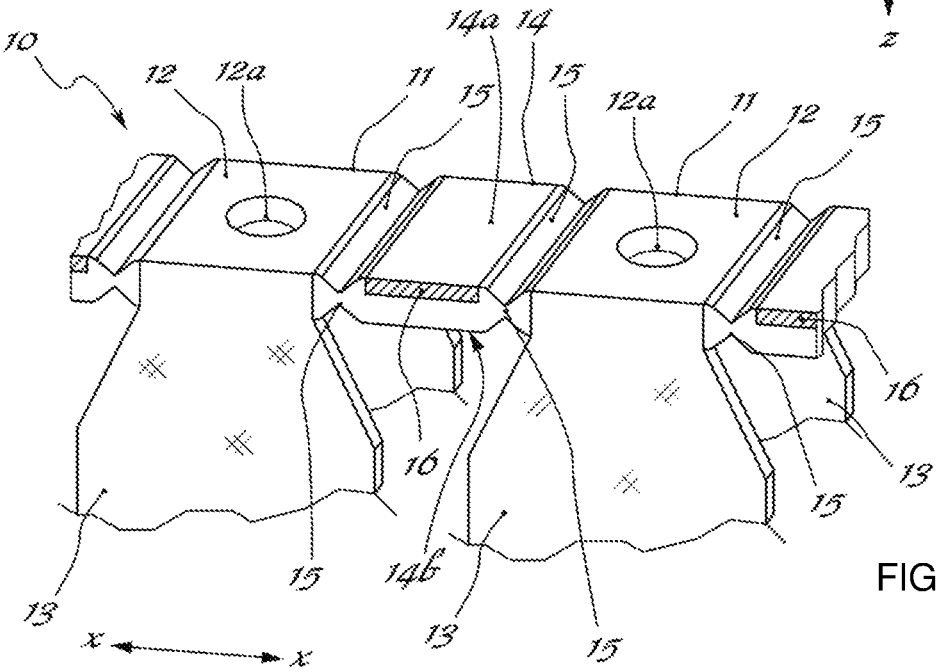
Figure 3:
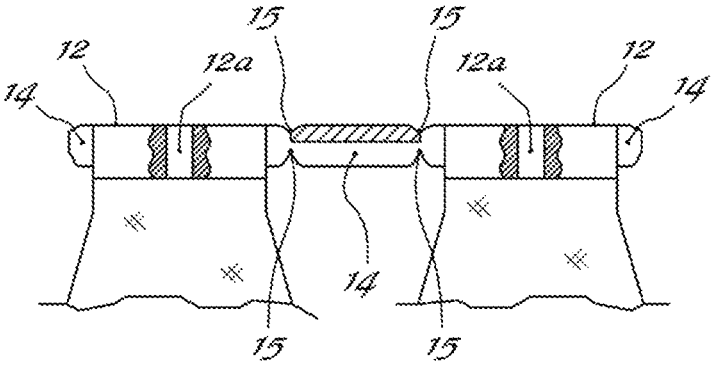
FIG. 3 shows a front view of the conducting body according to FIG. 2.

The conducting body 10 (FIG. 1*a*) includes two sub-bodies 11 with a shape substantially in the form of an overturned "U" with respective head 12 lying in a plane X-Y and contact plates 13 lying in planes X-Z situated opposite each other relative to the head 12. Each head 12 has a through-hole 12*a*. The two sub-bodies 11 are connected together in the longitudinal direction X-X by means of a tongue 14. The tongue 14 can have two V-shaped incisions 15 respectively formed on the top surface 14*a* and bottom surface 14*b* of the tongue, being situated opposite each other and extending parallel to the transverse direction Y-Y. The two incisions can form preferential breakage lines for the jumper, as shown in FIGS. 2 and 3.

In some implementations, the two edges of the tongue 14 parallel to the longitudinal direction X-X have a chamfer 16 inclined from the plane of the tongue downwards in the vertical direction Z-Z, with the orientation shown in the figure.

Figure 4:
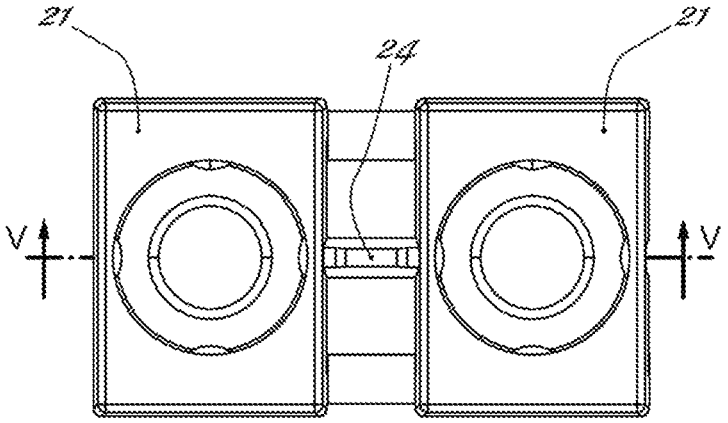
FIG. 4 shows a top plan view of the insulating body of the jumper according to the present subject matter.
Figure 5:
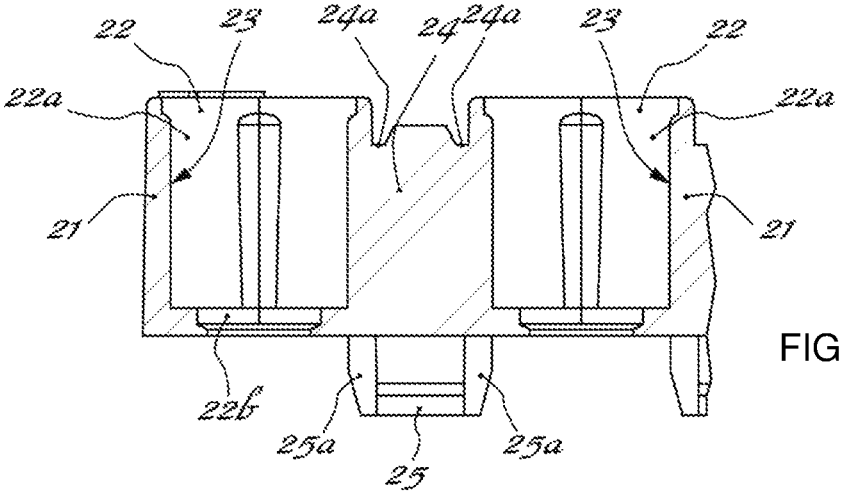
FIG. 5 shows a cross-section along the plane indicated by V-V of the insulating body according to FIG. 4.
Figure 6:
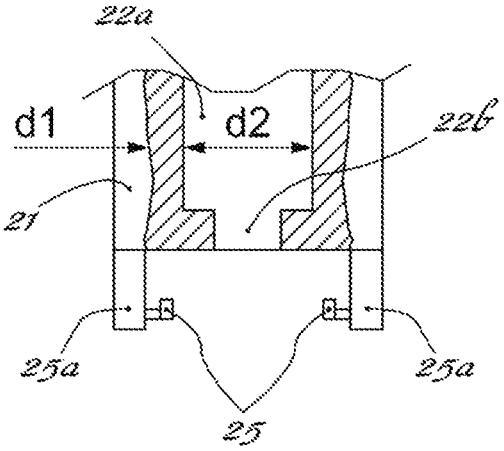
FIG. 6 shows a partially sectioned side view of the insulating body of a jumper according to the present subject matter.

The insulating body 20 (FIGS. 4,5,6) includes two sub-bodies 21 with a substantially parallelepiped—in the example cube-like—shape, made of suitable insulating material and connected together longitudinally (X-X) by a vertical membrane 24 having a reduced thickness in the transverse direction Y-Y. The reduced-thickness membrane can have at its respective ends two guide lines, so as to predefine a respective point for easy separation, which may be performed preferably manually (for example by means of folding along the guide line) or using a standard cutting tool. The two sub-bodies 21 are crossed by a through-hole 22 which can have (FIGS. 5, 6) a top section 22*a*, in the vertical direction Z-Z, with a greater diameter d1 and a bottom section 22*b*, coaxial in the same vertical direction Z-Z, with a smaller diameter d2.

At least two ribs 23 can also be provided inside the hole 22 and also engage within the diameter of the head so as to produce greater friction such that the screw cannot come loose. Examples of the arrangement of the ribs 23 are three ribs arranged with angular spacing of 120° or, as in the example shown in FIG. 5, four ribs 23 arranged with angular spacing of 90°.

In some implementations, the diameter d2 of the top section 22*b* substantially corresponds to the diameter of the head 31 of the screw 30. In some implementations, the diameter d2 of the bottom section 22*b* corresponds to the internal diameter of the thread 32*a* on the shank 32 of the screw 30.

The bottom surfaces of the insulating sub-bodies 21 define, during use, a plane for coupling with the conducting body 10, which is substantially parallel to the plane (X-Y) of the heads 12 of the conducting sub-bodies. The plane for coupling of the insulating body 20 with the conducting body 10 has, preferably along its longitudinal edges, situated on the outside in the transverse direction Y-Y (FIG. 5), a pair of arched lugs 25 situated opposite each other and extending in the longitudinal direction X-X so that the respective vertical arms 25 are respectively connected to the first and second adjacent sub-bodies 21. Each arched lug 25 also has (FIG. 6) a tooth 25*b* extending in the transverse direction Y-Y towards the inside of the conducting body 20 in the empty space situated between the two sub-bodies.

In some implementations, the two arched lugs 25 and the tooth 25*b* are elastically deformable so as to facilitate engagement of the insulating body 20 with the tongue 24 connecting the two sub-bodies 11 of the conducting body 10. The engagement can be further facilitated by the longitudinal chamfer 16 of the tongue 14, the chamfer allowing improved sliding with elastic deformation of the arm 25*a* with tooth 25*b*.

With this configuration of the conducting body 10 and insulating body 20, assembly of the jumper according to the current subject matter is performed by means of engagement of the insulating body 20 with the conducting body 10 by means of a relative pressure, which causes the temporary deformation of the arched lugs 25 which, expanding, allow the respective tooth 25*b* to pass below the connecting tongue 14 of the conducting sub-bodies 11 of the conducting body. The elastic return of the arched lugs into the rest position causes stable engagement of the insulating body with the conducting body.

The particular structure of the two bodies, i.e. conducting body 10 and insulating body 20, allows precise and repeatable joining together of the two parts with coaxial centering of the respective holes for precise insertion of the screw 30.

Figure 7A:
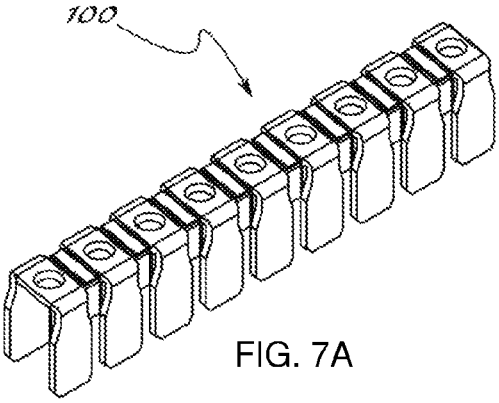
FIGS. 7*a* and 7*b* show perspective views of a strip of conducting sub-bodies and a strip of insulating sub-bodies, respectively.
Figure 7B:
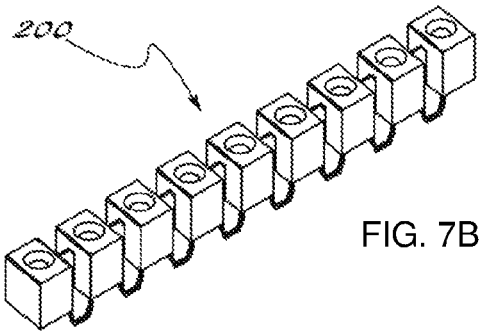
Figure 8A:
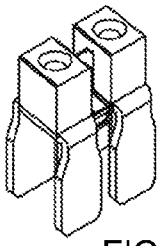
FIGS. 8*a* and 8*b* show a perspective view of a jumper and a multiple jumper in strip form according to the current subject matter, respectively.
Figure 8B:
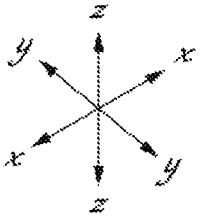
Figure 8B:
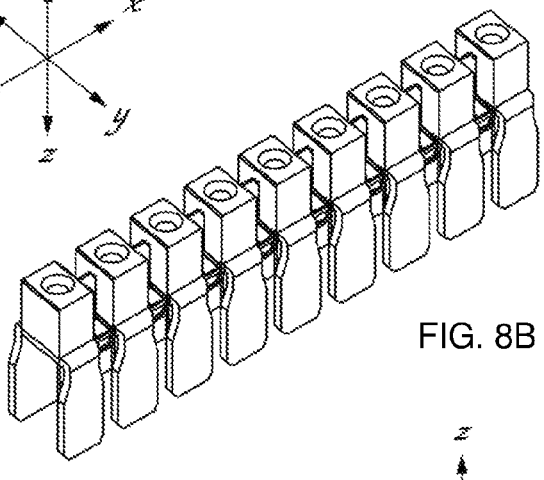

Both the conducting body 10 and the insulating body 20 may also be formed as strips 100,200 (FIG. 7*a*,7*b*) so as to form complete jumpers in strip form (FIGS. 8*a*,8*b*) from which the user may separate single jumpers or jumpers formed by several conducting and insulating sub-bodies as required, by simply breaking the tongue 14 between two adjacent sub-bodies of the conducting body 10 along each of the easy separation incisions 15 and separating the membrane 24 and the arched lug 25 of the insulating body 20 on the appropriate side of the connecting membrane. The insulating body 200 in the form of a strip can include respective arched lugs 25 between each insulating sub-body and the adjacent sub-body.

According to a preferred embodiment of the insulating body with hole 22 having different diameters d1 and d2, respectively corresponding to the diameter of the head or the threaded shank of the screw 30 and the associated ribs 23, upon insertion of the screw inside the holes of the jumper a relative interference with friction is created between the head or the shank—or between the head and the shank—of the screw and the respective insulating sub-body 21. The respective insulating sub-body 21 retains the screw inside the seat, preventing separation thereof also in the case of impacts and/or over-loosening by the user.

According to a preferred embodiment it is also envisaged that the strip can include twelve jumpers, a number which allows the separation of various jumpers or multiples of jumpers (2,3,4), limiting the amount of unusable waste.

It is possible, with the electrical connection screw-type jumper for switchboard terminal blocks according to the present subject matter, to provide conducting jumpers, which are assembled during production complete with insulating body and screw and are therefore ready for use by the end user. It also possible to ensure easy formation and/or separation/splitting to size of the jumper as well as prevent the screw from coming loose since can always be retained, as a result of friction, by the insulating body.

In particular, it is possible to provide the strips pre-assembled, the end user merely having to separate the insulating body, with corresponding screw not protruding therefrom, from the conducting body. Both the insulating body and the conducting body may be manually separated/split to size respectively along the guiding incisions of the central membrane, which joins together two adjacent insulating sub-bodies, and along easy breakage lines of the conducting bodies. The easy breakage lines are defined by the pairs of oppositely arranged V-shaped incisions which, in addition to allowing manual breakage, also ensure precise breakage corresponding to that of the insulating body so as to allow renewed joining together of the two parts cut to size.

Figure 9A:
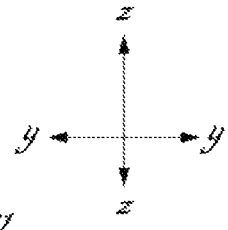
FIGS. 9*a* and 9*b* show a vertical section through a jumper according to the present subject matter applied onto a conducting bar for connecting a terminal block (not shown) in the mounted condition fixed by means of a screw.
Figure 9A:
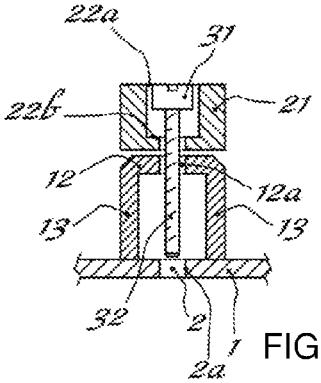
Figure 9B:
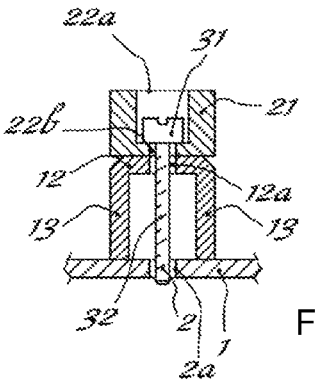

As shown in FIG. 9 the jumper according to the current subject matter may be applied onto a conducting bar 1 of a switchboard terminal block (not shown) in two stages. First, the jumper is arranged with screw 30 inserted in the vertical direction so that the shank 32 protrudes from the bottom edge of the hole 22 only by a small amount (a couple of threads). Second, the jumper is mounted on the bar 1 (FIG. 9*a*) with the screw 32 resting inside the hole 2 of the bar 1 and tightening the screw inside the hole 2 of the bar 1 (FIG. 9*b*) so as to compress the contact plates 13 of the conducting body against the bar 1, ensuring the required electrical contact.

As shown and used herein and assuming solely for the sake of easier description and without any limiting meaning, are a set of three reference axes, extending in a longitudinal lengthwise direction X-X of the jumper, transverse widthwise direction Y-Y of the jumper and vertical direction Z-Z perpendicular to the other two directions and parallel to the direction of extension of a screw for fixing to a terminal block.

In the descriptions above and in the claims, phrases such as "at least one of" or "one or more of" may occur followed by a conjunctive list of elements or features. The term "and/or" may also occur in a list of two or more elements or features. Unless otherwise implicitly or explicitly contradicted by the context in which it is used, such a phrase is intended to mean any of the listed elements or features individually or any of the recited elements or features in combination with any of the other recited elements or features. For example, the phrases "at least one of A and B;" "one or more of A and B;" and "A and/or B" are each intended to mean "A alone, B alone, or A and B together." A similar interpretation is also intended for lists including three or more items. For example, the phrases "at least one of A, B, and C;" "one or more of A, B, and C;" and "A, B, and/or C" are each intended to mean "A alone, B alone, C alone, A and B together, A and C together, B and C together, or A and B and C together." In addition, use of the term "based on," above and in the claims is intended to mean, "based at least in part on," such that an unrecited feature or element is also permissible.

The subject matter described herein can be embodied in systems, apparatus, methods, and/or articles depending on the desired configuration. The implementations set forth in the foregoing description do not represent all implementations consistent with the subject matter described herein. Instead, they are merely some examples consistent with aspects related to the described subject matter. Although a few variations have been described in detail above, other modifications or additions are possible. In particular, further features and/or variations can be provided in addition to those set forth herein. For example, the implementations described above can be directed to various combinations and subcombinations of the disclosed features and/or combinations and subcombinations of several further features disclosed above. In addition, the logic flows described herein do not necessarily require the particular order shown, or sequential order, to achieve desirable results. Other implementations may be within the scope of the following claims.

The invention claimed is:

1. An electrical connection jumper, of a screw type in particular for switchboard terminal blocks, extending in a longitudinal lengthwise direction, transverse widthwise direction and vertical direction perpendicular to preceding directions, and comprising:

a conducting body including at least two conducting sub-bodies, each conducting sub-body substantially in the form of an overturned "U" and being connected in the longitudinal direction by means of a tongue, each conducting sub-body having:

a respective head lying in a plane parallel to the longitudinal direction and transverse direction, each head having a through-hole in the vertical direction; and respective contact plates lying in planes parallel to the longitudinal direction and vertical direction and situated opposite each other in the transverse direction relative to the head for electric contact with a conductive bar of a switch board terminal block;

an insulating body including at least two insulating sub-bodies with a substantially parallelepiped shape, made of insulating material and connected together longitudinally by a vertical membrane of reduced thickness in the transverse direction, each insulating sub-body having, passing through it, a respective vertical through-hole;

wherein the insulating body has a coupling plane for coupling with the conducting body, the coupling plane includes, between each insulating sub-body and the adjacent insulating sub-body, a pair of arched lugs situated opposite each other in the transverse direction and extending in the longitudinal direction so that the respective vertical arms are respectively connected to each one of the adjacent insulating sub-bodies, each arched lug having a tooth extending in the transverse direction towards the inside of the insulating body in empty space between the two insulating sub-bodies, the arched lug with tooth allowing relative reversible engagement of the insulating body and the conducting body; and at least two screws for engaging a screwed hole of the conductive bar of a terminal block, each of the at least two screws insertable into the through-hole of a respective sub-body of the insulating sub-bodies.

2. The jumper according to claim 1 wherein the hole in the insulating sub-bodies of the insulating body has a top section, in the vertical direction, with a larger diameter, and a bottom section, coaxial in the same vertical direction, with a smaller diameter.

3. The jumper according to claim 1 wherein the connecting tongue between the at least two conducting sub-bodies has incisions in the form of a V formed in a top surface and a bottom surface of the tongue, situated opposite each other and extending parallel to the transverse direction to form preferential breakage lines of the jumper.

4. The jumper according to claim 1 wherein the tongue includes two edges parallel to the longitudinal direction and having a chamfer incline from a plane of the tongue downwards in the vertical direction.

5. The jumper according to claim 2 wherein the diameter of the top section of the hole in the insulating sub-body corresponds to a diameter of a head of the screw.

6. The jumper according to claim 2 wherein the diameter of the bottom section of the hole in the insulating sub-body corresponds to the internal diameter of a thread of the respective screw.

7. The jumper according to claim 1 wherein the hole has internally:

at least two vertical ribs designed for frictional engagement with the head of the screw, three ribs arranged with an angular spacing of 120°, or four ribs arranged with an angular spacing of 90°.

8. The jumper according to claim 1 wherein the jumper is formed as a strip of a length in the longitudinal direction.

9. The jumper according to claim 8 wherein the strip has twelve conducting sub-bodies joined together by respective connecting tongues.

10. The jumper according to claim 1 wherein pairs of opposite arched lugs extend from the longitudinal edges, situated on the outside in the transverse direction, of the plane for coupling with the conducting body.

* * * * *